US010861286B2

(12) United States Patent
Marsh et al.

(10) Patent No.: US 10,861,286 B2
(45) Date of Patent: Dec. 8, 2020

(54) ENHANCED VISUALIZATION OF GAME WAGER OUTCOMES PROVIDED BY SYMBOL COLLECTORS IN A GAME DISPLAY

(71) Applicant: Aristocrat Technologies Australia Pty Limited, North Ryde (AU)

(72) Inventors: David Marsh, Charlottesville, VA (US); Karl Roelofs, Charlottesville, VA (US)

(73) Assignee: Aristocrat Technologies Australia PTY Limited

( * ) Notice: Subject to any disclaimer, the term of this patent is extended or adjusted under 35 U.S.C. 154(b) by 279 days.

(21) Appl. No.: 15/891,769

(22) Filed: Feb. 8, 2018

(65) Prior Publication Data

US 2019/0244480 A1 Aug. 8, 2019

(51) Int. Cl.
*A63F 9/24* (2006.01)
*G07F 17/32* (2006.01)

(52) U.S. Cl.
CPC ..... *G07F 17/3267* (2013.01); *G07F 17/323* (2013.01); *G07F 17/329* (2013.01); *G07F 17/3213* (2013.01); *G07F 17/3255* (2013.01); *G07F 17/3258* (2013.01); *G07F 17/3262* (2013.01)

(58) Field of Classification Search
CPC ..... G07F 17/3267; G07F 17/3258; G07F 17/3255; G07F 17/323; G07F 17/3262; G07F 17/329; G07F 17/3213
See application file for complete search history.

(56) References Cited

U.S. PATENT DOCUMENTS 10,311,668 B1 * 6/2019 Halvorson ..... G07F 17/3213
2003/0211879 A1 * 11/2003 Englman ..... G07F 17/3244 463/20
2004/0110555 A1 * 6/2004 Devaull ..... G07F 17/32 463/20
2006/0025198 A1 * 2/2006 Gail ..... G07F 17/32 463/19
2006/0247018 A1 * 11/2006 Walker ..... G07F 17/32 463/20

(Continued)

*Primary Examiner* — Dmitry Suhol
*Assistant Examiner* — Carl V Larsen
(74) *Attorney, Agent, or Firm* — McAndrews, Held & Malloy, Ltd.

(57) ABSTRACT

Systems, apparatuses, and methods that provide a bingo game wager outcome via symbol collector(s) in a spinning reel game are disclosed. A game controller of a gaming device receives a bingo game outcome in response to a wager. The game controller selects a spinning reel game outcome based on the received bingo game outcome and spin reels of the spinning reel game to obtain the spinning reel game outcome. The game controller collects feature symbols from an array of the symbols presented in the spinning reel game in symbol collector(s). The game controller provides an award from the symbol collector(s) corresponding to a portion of the feature symbols collected in the symbol collector(s) and increases the credit balance of a credit meter by an amount equivalent to the bingo game outcome at least in part in response to the award provided from the symbol collector(s). Numerous additional aspects are disclosed.

9 Claims, 15 Drawing Sheets

(56) References Cited

U.S. PATENT DOCUMENTS

| | | | | |
|---|---|---|---|---|
| 2010/0120495 | A1* | 5/2010 | Frank | G07F 17/3211 463/20 |
| 2011/0117992 | A1* | 5/2011 | Nelson | G07F 17/32 463/20 |
| 2011/0151957 | A1 | 6/2011 | Falciglia, Sr. | |
| 2011/0218027 | A1* | 9/2011 | Manz | G07F 17/3244 463/19 |
| 2012/0244928 | A1* | 9/2012 | Visser | G07F 17/3225 463/21 |
| 2013/0065665 | A1* | 3/2013 | Watkins | G07F 17/32 463/20 |
| 2013/0157741 | A1 | 6/2013 | Pacey et al. | |
| 2014/0087855 | A1* | 3/2014 | Caputo | G07F 17/3258 463/26 |
| 2014/0120998 | A1* | 5/2014 | Chang | G07F 17/3258 463/19 |
| 2014/0364193 | A1* | 12/2014 | Williamson | G07F 17/326 463/21 |
| 2016/0035176 | A1* | 2/2016 | Forman | G07F 17/329 463/19 |
| 2018/0102027 | A1* | 4/2018 | Paiva | G07F 17/3267 |
| 2019/0088077 | A1* | 3/2019 | Zehetner | G07F 17/3241 |

* cited by examiner

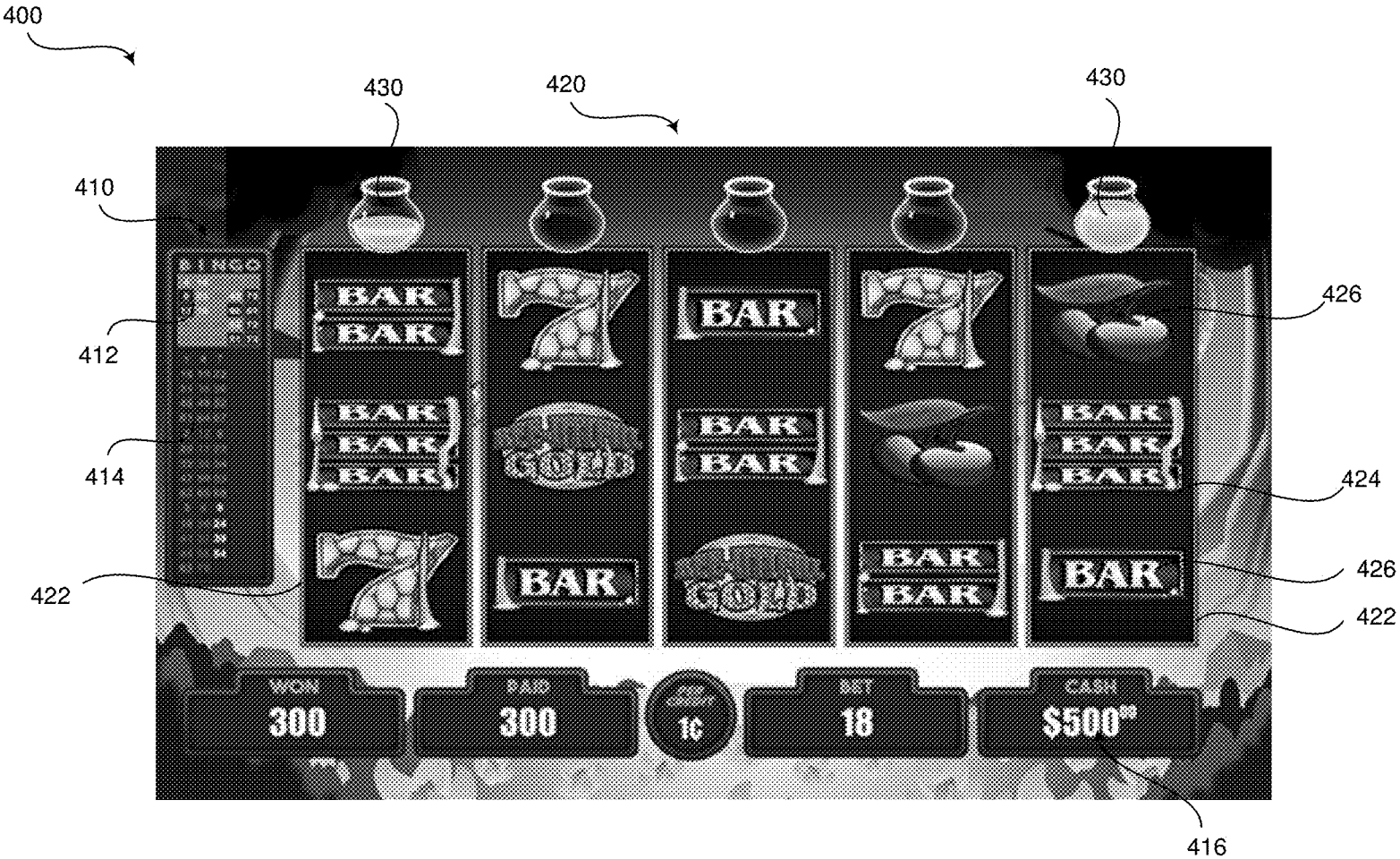
400
410
412
414
422
420
430
430
426
424
426
422
416
BAR
BAR
BAR

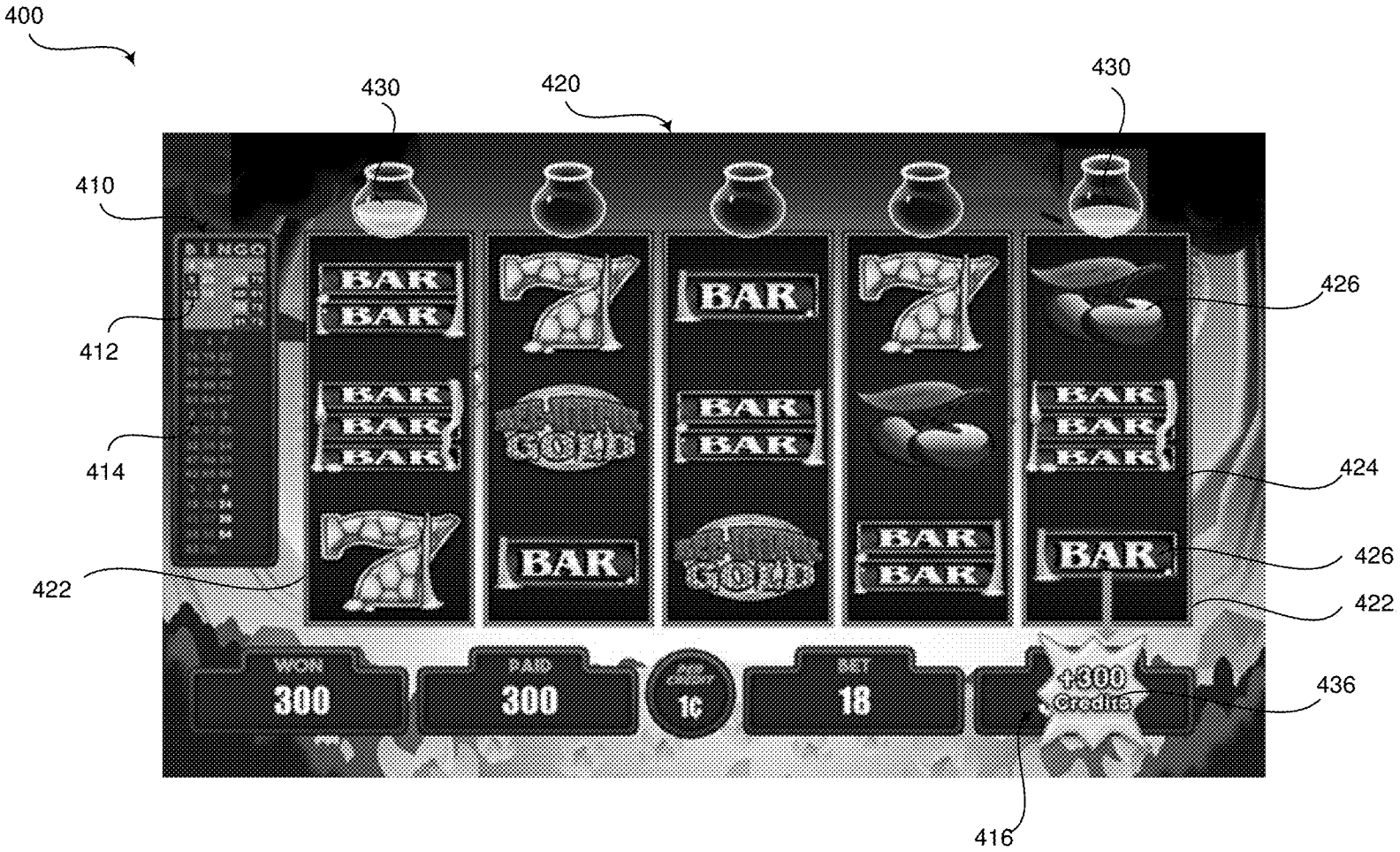
400
410
412
414
422
420
430
430
426
424
426
422
436
416
BAR
BAR
BAR

ENHANCED VISUALIZATION OF GAME WAGER OUTCOMES PROVIDED BY SYMBOL COLLECTORS IN A GAME DISPLAY

TECHNICAL FIELD

The present disclosure relates to gaming and wagering, and more specifically to electronic gaming machines that permit wagering upon outcomes of bingo games. In various embodiments, the bingo game outcomes are simulated as a spinning reel game having symbol collector mechanisms operable to collect symbols from reels of the spinning reel game and reward a player via the symbol collector mechanisms in the event of a winning bingo game outcome.

BACKGROUND

Electronic gaming machines ("EGMs") provide a variety of wagering games such as slot games, video poker games, roulette games, keno games, and other types of games that are frequently offered at casinos and other locations for use by players. Play on EGMs typically involves a player placing a wager on outcomes of a primary game. On many such EGMs, secondary games or bonus rounds are also available after the player qualifies by attaining a certain winning combination or event on or related to the primary game. Once qualified, the player then enters the secondary game or bonus round where they are given an opportunity to win extra game credits, game tokens or other awards. In the case of "game credits" that are awarded during play of a primary game or play of a bonus game, the credits are typically added to a credit meter total on the EGM and provided to the player upon completion of a gaming session when the player "cashes out."

SUMMARY

Systems, apparatuses, and methods are disclosed for providing bingo game wager outcomes by paying out from a portion of feature symbols collected in one or more symbol collectors in a spinning reel game, substantially as shown in and/or described in connection with at least one of the figures, as set forth more completely in the claims.

Still other features, aspects, and advantages of embodiments will become more fully apparent from the following detailed description, the appended claims, and the accompanying drawings illustrating a number of example embodiments and implementations, including the best mode contemplated for carrying out the embodiments. Embodiments may also be capable of other and different applications, and several details may be modified in various respects, all without departing from the spirit and scope of the disclosed embodiments. Accordingly, the drawings and descriptions are to be regarded as illustrative in nature, and not as restrictive. The drawings are not necessarily drawn to scale.

BRIEF DESCRIPTION OF THE DRAWINGS

In the drawings, various dimensions may be exaggerated for illustrative clarity. Additionally, like reference numbers are utilized to refer to like elements throughout the present disclosure.

FIGS. 4A-D depict an exemplary embodiment of a display at the gaming device of FIG. 1 in various stages of exemplary processes for partially paying out credits from one or more symbol collectors corresponding with feature symbols collected in the symbol collectors while simulating a bingo game outcome via the spinning reel game in accordance with various aspects of the present disclosure.

DETAILED DESCRIPTION

Figure 1:
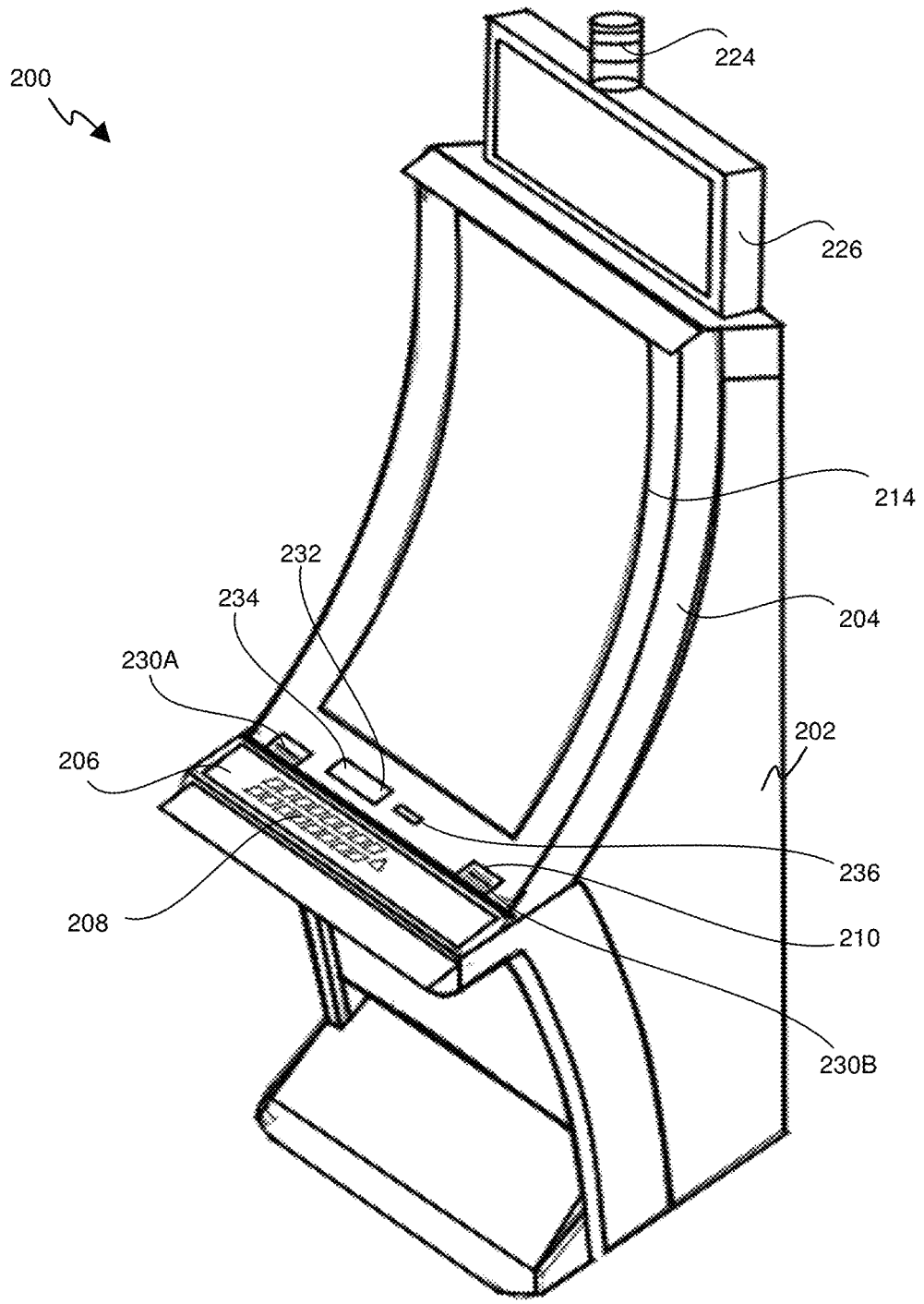
FIG. 1 depicts an exemplary gaming device in accordance with various aspects of the present disclosure.

The following description presents various aspects of the present disclosure by way of various examples and example embodiments. Such examples and example embodiments are intended to be non-limiting. Thus, the scope of various aspects of the present disclosure should not necessarily be limited by any particular characteristics of the presented examples and example embodiments. In particular, the phrases "for example," "e.g.," and "exemplary" are intended to be non-limiting in nature and are generally synonymous with "by way of example and not limitation," "for example and not limitation," and the like.

Various aspects of the present disclosure are directed to gaming systems and gaming devices that simulate bingo game outcomes as a spinning reel game having one or more symbol collectors operable to collect feature symbols from reels of the spinning reel game and reward a player via the symbol collector(s) in the event of a winning bingo game outcome by paying out a portion of the symbols and/or corresponding credits collected by the symbol collector(s). In some embodiments, a gaming device may include one or more displays having a bingo game display portion and a spinning reel game display portion. The bingo game display portion may include one or more bingo cards purchased with a wager by a player. Although described herein in respect of a bingo type (Class II) gaming machine, the present invention may also be implemented on a standard (Class III or other type) of EGM.

The bingo game display portion may also include a listing of drawn numbers corresponding with a sequence of randomly selected numbers. The sequence of randomly selected numbers is compared to the numbers in the cells of the bingo card(s) to identify matching numbers. In an exemplary embodiment, the matching numbers may be visually distinguished from non-matching numbers in the bingo card(s) and/or the number listing by a different color, highlighting, or any suitable visual distinction.

The player or players of a plurality of players participating in the bingo game that achieve a winning combination may be awarded a payout based on an amount wagered and an associated predefined pay table. For example, a winning combination may correspond with a full row, full column, and/or a 5-cell diagonal of numbers in the bingo card that match numbers in the listing of numbers. The bingo game outcome may be a loss for player(s) not achieving the winning combination and/or if another player achieves a winning combination first. The winning or losing bingo game outcomes are presented to each of the players in a spinning reel game that simulates the appropriate bingo game outcome.

In various embodiments, the spinning reel game display may be more prominent than the bingo game display. For example, the spinning reel game display may be much larger and/or centrally located, whereas the bingo game display may be much smaller and positioned off to a side, top, or bottom of the gaming device display. In this way, the gaming device provides a spinning reel player gaming experience despite the results of the spinning reel game being determined by an associated bingo game.

In an exemplary embodiment, the spinning reel game display portion of the gaming device may include three, five, or any suitable number of video or mechanical reels. Each reel may have a thin, cylindrical shape. Moreover, each reel may be arranged in a side-by-side manner such that each reel shares a horizontal axis of rotation and an outer circumference of each reel is presented to a player of the gaming machine via a main display. Each reel may further carry symbols along its outer circumference of the reel such that each reel presents a column of symbols to the player via the main display of the gaming device. The main display of the gaming device may mask the reels such that only a small subset of the symbols carried by each reel is visible to the player when the reels are in rest or stopped position. In some embodiments, the main display is configured to display three symbols from each reel. For example, the main display may present a 3×3 array of symbols, 3×5 array of symbols, or any suitable array corresponding with the number of reels and number of display positions per reel. More specifically, the main display may present three rows of symbols with each row having, three symbols, five symbols, or any suitable number of symbols corresponding to the number of reels.

In such embodiments, in response to a received bingo game outcome, the gaming device may spin the reels and may stop each reel in a position determined based on the bingo game outcome to obtain a spinning reel game outcome comprising an array of symbols. In some embodiments, one or more symbol collectors may be presented with the spinning reels, such as directly above the spinning reels or at any suitable position. For example, the symbol collectors may be game characters such as a honey pot or any suitable game character. The symbol collector game character(s) may be configured to show various states of symbol collection, such as empty, partially-filled, or full. In various embodiments, a tally of the number of symbols or a corresponding credit amount may be presented on or near each of the symbol collector game characters. In certain embodiments, a tally of the number of feature symbols collected or a corresponding credit amount is not presented at the display.

The gaming device may then analyze the array of symbols to determine whether the array of symbols includes one or more feature symbols, such as a WILD symbol, a feature character symbol, or any suitable feature symbol. The gaming device may collect the feature symbols in the symbol collector(s). For example, each honey bee feature symbol (or a sub-symbol generated from the feature symbol) in the array of symbols may fly up to a honey pot symbol collector and the honey pot symbol collector may update to show an increased amount of honey in the honey pot symbol collector.

The gaming device may then provide a payout that corresponds to the bingo game outcome via a partial amount of the feature symbols and/or corresponding credits collected by the one or more symbol collectors. In a first embodiment, one or more of the symbol collectors may directly provide credits that are added to the credit meter. For example, in the honey pot example described above, one or more honey pot symbol collectors may spill over credits that increase the credit meter. The number of credits provided by the symbol collector(s) is equivalent to the prize awarded by the bingo game outcome. The number of credits may be a partial amount of credits stored in the symbol collector(s). For example, if a symbol collector currently holds 500 credits and a 300 credit is being awarded, the symbol collector may spill out the 300 credits to the credit meter leaving 200 credits in the symbol collector. In certain embodiments, a credit tally presented on or near the symbol collector game characters may be updated based on the credit payout. The prize award may be initiated by the symbol collection and/or a winning combination shown on the array of symbols. In an exemplary embodiment, the fill status of the symbol collectors (e.g., empty, partially-filled, full, etc.) may carry over after each bingo game outcome.

In a second embodiment, one or more of the symbol collectors may generate one or more special symbols that are added to the array of symbols of the same spinning reel game. The special symbols may be WILD symbols or any suitable symbol. For example, in the honey pot example described above, one or more honey pot symbol collectors may spill over and provide a WILD symbol that replaces a standard symbol in the array of symbols.

After the one or more special symbols replace corresponding symbols in the array of symbols, the gaming device may analyze the array of symbols to determine whether the array of symbols includes a winning combination of symbols. If any winning combination of symbols are present, the gaming device may award prizes for each winning combination of symbols. For example, the gaming device may increase a credit meter by a number of credits specified in a pay table for the winning combination of symbols. In various embodiments, the awarded special symbols may or may not contribute to a winning combination of symbols. The awarded prizes are equivalent to the prize awarded by the bingo game outcome.

Various advantages and features of the present disclosure will become apparent and more clearly understood in view of the detailed description, appended claims, drawings of the present disclosure. In the following description, reference is made to drawings which show by way of illustration various disclosed embodiments that incorporate various aspects of the present disclosure. These embodiments are described in sufficient detail to enable those skilled in the art to make or use the disclosed embodiments. Other embodiments may be utilized and that structural, logical, software, hardware, and electrical changes may be made without departing from the scope of the appended claims. The following description is, therefore, not to be taken in a limited sense.

Gaming Device

Figure 2:
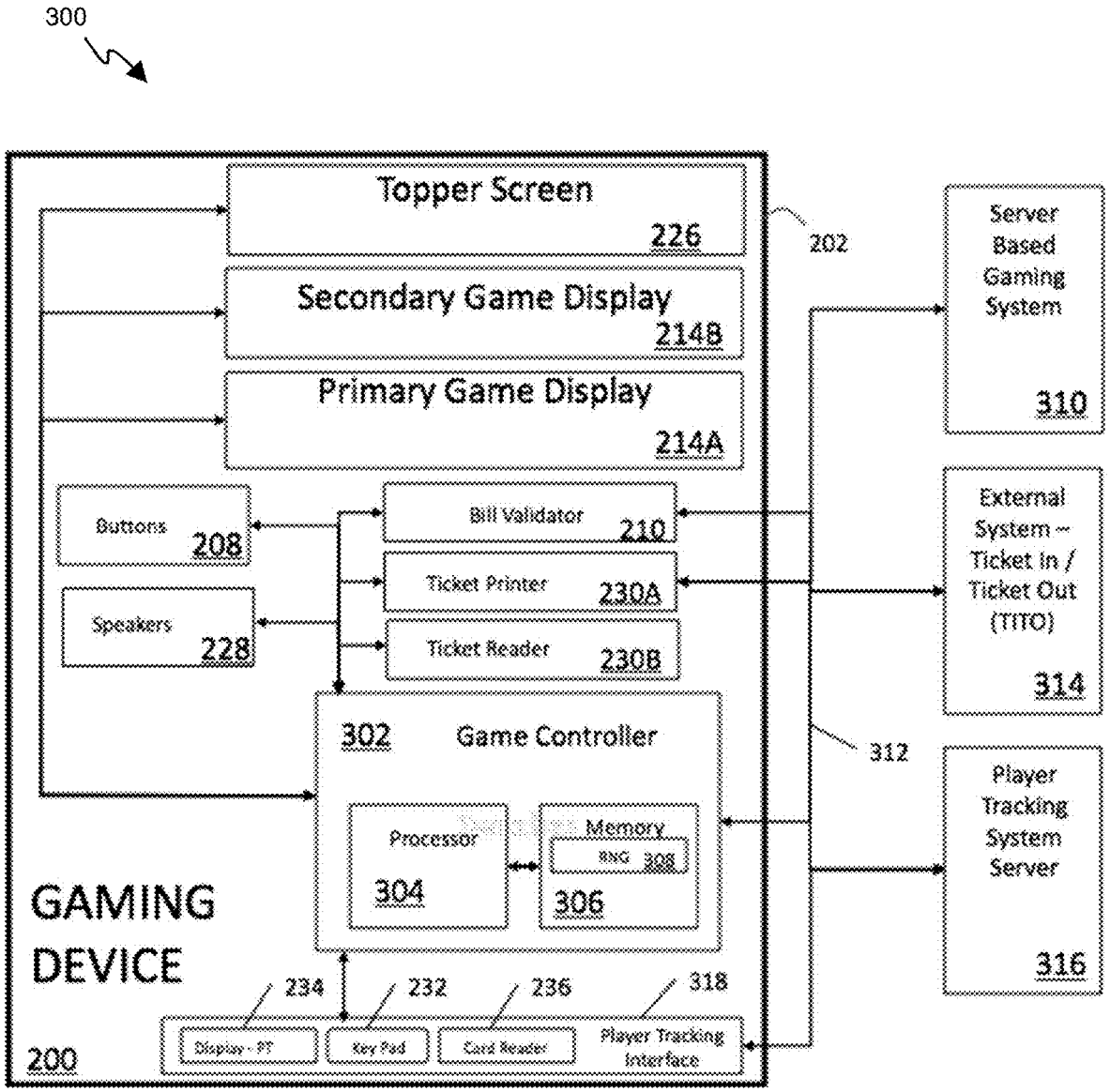
FIG. 2 depicts an exemplary embodiment of a gaming system in accordance with various aspects of the present disclosure.

FIG. 1 depicts an exemplary gaming device 200 in accordance with various aspects of the present disclosure. Referring to FIG. 1, the gaming device 200 may include a main cabinet 202 including a main door 204 which opens to provide access to the interior of the gaming device 200. In particular, the main cabinet 202 may house circuitry, electrical components, and electromechanical components of the gaming device 200. In particular, the main cabinet 202 may house a game controller (see, e.g., FIG. 2) configured to control the various components of the gaming device 200 and execute a wagering game as described in detail below. The main cabinet 202 may also include a button deck 206 with buttons 208, which a player may actuate in order to operate the gaming device 200 and play a wagering game. Various other components may be housed by the main cabinet 202 or mounted to the main cabinet 202. For example, the gaming device 200 includes a sound system and speakers 228 (as shown in FIG. 2) that may be mounted to or housed by the main cabinet 202 for playing game sound effects and music to enhance the player's game play experience.

A credit input mechanism 210 such as a bill validator or coin-in slot may also be mounted to the main cabinet 202. The credit input mechanism 210 may receive physical items associated with a monetary value such as coins, bills, etc. to permit the gaming device to establish an associated credit value of a credit meter. In some embodiments, a credit output mechanism such as coin tray or coin chute may also be mounted to the main cabinet 202. Such credit output mechanism may permit the gaming device 200 to dispense coins when a player cashes out any remaining credits on the credit meter or to dispense winning directly to the player in lieu of increasing the credit meter.

As shown, the gaming device 200 includes a main display 214 mounted above the button deck 206. The main display 214 may include a high-resolution LCD, plasma, LED, or OLED panel which may be in a portrait configuration with curvature radius from top to bottom as shown.

In some embodiments, the bill validator 210 may also function as a "ticket in" reader 230B that allows the player to use a casino issued credit ticket to load credit onto the gaming device 200 (e.g., in a cashless ticket system). In such cashless embodiments, the gaming device 200 may also include a "ticket out" printer 230A for outputting a credit ticket when a "cash out" button is pressed. Cashless ticket systems may be used to generate and track unique bar-codes that are printed on tickets. Such tickets allow players to avoid the use of bills and coins for loading credits on a credit meter of the gaming device 200. Instead, players may load credits using a ticket reader 230B and may cash out credits from the credit meter through the use of the ticket printer 230A.

In some embodiments, the gaming device 200 may include a player tracking interface 318 (see, e.g., FIG. 2) that includes a card reader 236, a transceiver for wireless communication with a player's smartphone, a key pad 232, and/or an illuminated display 234 for reading, receiving, entering, and/or displaying player tracking information. In such embodiments, the gaming device 200 may communicate with the server 102 via the player tracking interface 318 to send and receive player tracking information.

In various embodiments, the gaming device 200 may not include physical reels and instead shows game play functions on the main display 214. The gaming device 200 may further include an optional topper screen 226. The topper screen 226 may be used as a secondary game display for bonus play or may be used to show game features or attraction activities while the game is not in play. The topper screen 226 may also display any other information or media desired by the game designer or operator. In some embodiments, the topper screen 226 may also be used to display progressive jackpot prizes available to a player during play of gaming device 200.

A candle 224 may be mounted on the top of gaming device 200. In some embodiments, a player may activate the candle 224 via a button 208 in order to inform operations staff that the gaming device 200 has experienced a malfunction or that the player requires service.

While an example gaming device 200 has been described in regard to FIG. 1, certain aspects of the present disclosure may be implemented by gaming devices that lack one or more of the above-described components. For example, not all gaming devices suitable for implementing aspects of the present disclosure necessarily include top boxes, information panels, cashless ticket systems, and/or player tracking systems. Further, some suitable gaming devices may include a single game display having a mechanical reels or a video display. Moreover, other embodiments may be designed for bar tables and have displays that face upwards.

Many different types of wagering games, including mechanical slot games, video slot games, video poker, video black jack, video pachinko, keno, bingo, and lottery, may be provided by the gaming device 200. In particular, a gaming device 200 may be operable to provide many different instances of games of chance. The instances may be differentiated according to themes, sounds, graphics, type of game (e.g., slot game vs. card game vs. game with aspects of skill), denomination, number of paylines, maximum jackpot, progressive or non-progressive, bonus games, class 2 or class 3, etc.

The gaming device 200 may allow a player to select a game of chance, skill, or combination thereof, to play from a plurality of instances available on the gaming device 200. For example, the gaming device 200 may provide a menu with a list of the instances of games that are available for play on the gaming device 200 and a player may be able to select from the list a game that they wish to play.

Turning now to FIG. 2, a block diagram of an exemplary embodiment of a gaming system 300 is shown. FIG. 2 depicts internal electronic components of the example gaming device 200. FIG. 2 further shows such internal components connected to external systems via a communications network 312. The various instances of games available for play on the gaming device 200 are controlled by a game controller 302. The game controller 302 may include a processor 304 and memory 306 configured to store game software having a plurality of instructions that, when executed by the processor 304, cause the gaming device 200 to implement a wagering game. The memory 306 may include one or more mass storage devices or media housed within main cabinet 202.

The game controller 302 may also include a pseudo-random number generator or RNG 308. The RNG 308 can be implemented via hardware and/or software. Moreover, the RNG 308 may generate random numbers that are used in the operation of game play to ensure that game play outcomes are random and meet regulations for a game of chance.

Alternatively, in some embodiments, a game instance may be generated on a remote gaming device such as a server based gaming system 310. The game instance is communicated to gaming device 200 via network 312 and then displayed on gaming device 200. Gaming device 200 may execute game software, such as but not limited to video streaming software that allows the game to be displayed on gaming device 200. When an instance is stored on gaming device 200, the instance may be loaded from a memory (e.g., from a read only memory (ROM)) or from the server based gaming system 310 to the memory 306. The memory 306 may be RAM, ROM, a combination of the two types or another form of storage media that stores instructions for execution by processor 304.

Gaming device 200 may include a topper screen 226 or another form of a top box (e.g., a topper wheel) which sits on top of cabinet 202. In addition to the components described above, either main cabinet 202 or topper screen 226 also house a number of other components which may be used to add features to a game being played on gaming device 200, including speakers 228, a ticket printer 230A which prints bar-coded tickets, a ticket reader 230B which reads bar-coded tickets, a key pad 232 for entering player tracking information, an illuminated display 234 for displaying player tracking information, a card reader 236 for receiving data and/or communicating information to and from media or a device such as a smart phone enabling player tracking. Ticket printer 230A may be used to print tickets for a cashless ticketing system 314.

Gaming device 200 may be connected over network 312 to player tracking system server 316. Player tracking system server 316 may be, for example, an OASIS® system manufactured by Aristocrat Technologies, Inc. Player tracking system server 316 may track play for individual players so that an operator may reward players in a loyalty program. To this end, a player may use the player tracking interface 318 that includes player tracking keypad 232, player tracking display 234, and card reader 236 to provide information from which the player tracking system server 316 may identify the player.

While FIG. 2 provides details regarding one embodiment of the gaming device 200, aspects of the present disclosure may be implemented with gaming devices having more or fewer elements than are depicted in FIG. 2. For example, some gaming devices in accordance with aspects of the present disclosure may lack a player tracking interface 318. Moreover, although the gaming system 300 shown in FIG. 2 illustrates one specific example gaming device 200, the gaming system 300 is by no means the only gaming device architecture for implementing various aspects of the present disclosure. For example, an architecture having a single processor that handles communications as well as routing computations, etc. may be used. Further, other types of interfaces and media could also be used with the gaming device 200. The communication path between components may be bus based (as shown in FIG. 2) or switch fabric based (such as a cross-bar).

Figure 3:
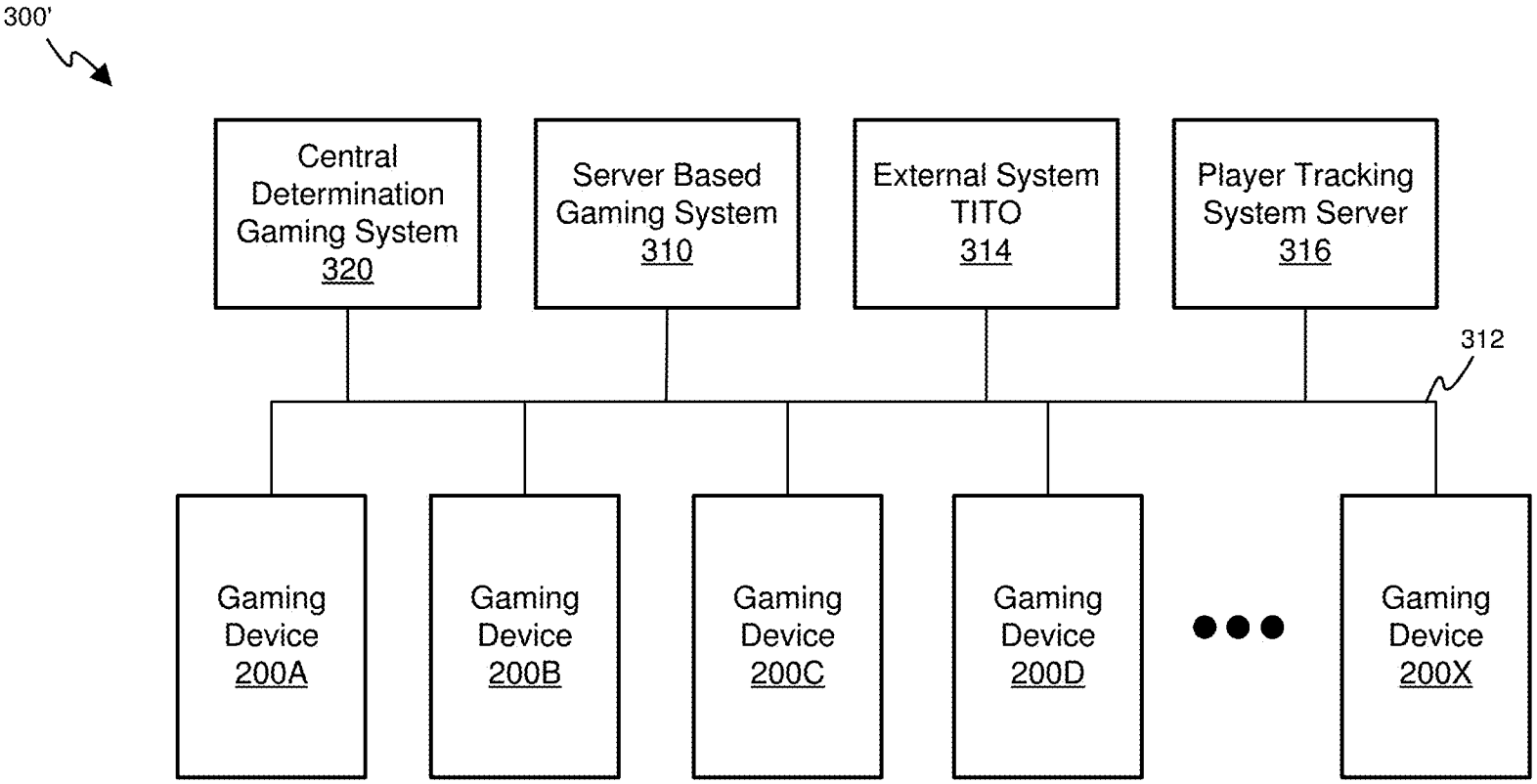
FIG. 3 depicts another exemplary embodiment of a gaming system in accordance with various aspects of the present disclosure.

FIG. 3 depicts a gaming system 300' which is an alternative embodiment of the gaming system 300 of FIG. 2. The gaming system 300' includes a central determination gaming system 320. A game outcome may be generated on central determination gaming system 320. The game outcome is then transmitted over network 312 to any one of the gaming devices 200A-X that utilize the game outcome and display the result to the player. In various embodiments, such as in a class 2 game, the results of the primary game (e.g., bingo) may be transmitted over network 312 to the appropriate gaming device 200A-X for presentation to the player via a simulated game (e.g., a spinning reel game, keno, blackjack, etc.). For example, the gaming device 200A-X may receive the results of the primary game and generate a simulated game having results corresponding to the received results of the primary game.

Some aspects of the present disclosure may be advantageously practiced via a networked server based gaming system 310. Examples of such networked server based systems are described in U.S. Pub. 2007/0026935, by Wolf et al., entitled "METHODS AND DEVICES FOR MANAGING GAMING NETWORKS" and filed Sep. 12, 2005, which is incorporated herein by reference in its entirety and for all purposes.

General Operation

Returning now to the example of FIG. 2, when a user wishes to play the gaming device 200, he or she inserts cash through the coin acceptor or bill validator 210. Alternatively, bill validator 210 may include ticket reader 230B enabling the acceptance of a printed ticket voucher which may be accepted as an indicia of credit when a cashless ticketing system 314 is used. At the start of the game, the player may enter playing tracking information using card reader 236, keypad 232, and the display 234. Further, other game preferences of the player playing the game may be read from a card inserted into the card reader 236. During the game, the player views game information using video displays 214A, 214B. Other game and prize information may also be displayed on topper screen 226.

During the course of a game, a player may be required to make a number of decisions, which affect the outcome of the game. For example, a player may vary his or her wager on a particular game, select a prize for a particular game selected from a prize server, or make game decisions which affect the outcome of a particular game. The player may make these choices using the player-input buttons 208, the video display screen 214 which may be a touch screen, or using some other device which enables a player to input information into the gaming device 200. In some embodiments, the player may be able to access various game services such as concierge services and entertainment content services using video display screen 214 and one or more input devices.

During certain game events, the gaming device 200 may display visual, auditory, and other sensory effects that can be perceived by the player. These effects add to the excitement of a game, which makes a player more likely to continue playing. Auditory effects include various sounds that are projected by the speakers 228. Visual effects include flashing lights, strobing lights, or other patterns displayed from lights on the gaming device 200 or from lights behind an information panel. After the player has completed a game, the player may receive game credits, game tokens from a credit output mechanism such as a coin tray (not shown) or a ticket from printer 230A, which may be used for further games or to redeem a prize. Further, the player may receive a ticket for food, merchandise, or games from printer 230A.

Symbol Collectors Feature

Further details regarding the operation and arrangement of the spinning reels provided to simulate a bingo game outcome will be addressed with reference to FIGS. 4-7. While the gaming device 200 may simulate or animate spinning reels via main display 214, the below description does not distinguish between animated reels and mechanical reels. Unless otherwise explicitly specified in the below description or in the appended claims, the aspects of the present disclosure are applicable to animated reels as well as mechanical reels.

FIGS. 4A-D and 5A-D depict exemplary embodiments of a display 400, 500 at the gaming device 200 of FIG. 1 in various stages of exemplary processes for partially paying out credits 436 from one or more symbol collectors 430 corresponding with feature symbols collected in the symbol collectors 430 while simulating a bingo game outcome via the spinning reel game in accordance with various aspects of the present disclosure. The exemplary embodiment of FIGS. 4A-D includes a plurality of symbol collectors 430. The exemplary embodiment of FIGS. 5A-D includes one symbol collector 430. Referring to FIGS. 4A-D and 5A-D, the display 400, 500 may be presented, for example, at a main display 214 of the gaming device 200. The display 400, 500 may include a bingo game display portion 410, a spinning reel game display portion 420, and a credit meter 416 showing the amount of credits 416 held by a player of the gaming device 200. In various embodiments, the spinning reel game display portion 420 may correspond to the primary game display 214A and the bingo game display portion 410 may correspond with the secondary game display 214B portions of the main display 214 of the gaming device 200.

The bingo game display portion 410 may include one or more bingo cards 412 acquired by a player based on a wager. The bingo card(s) 412 may be provided to the gaming device 200 by a server 310, 320 hosting the bingo game. The bingo game is played by at least two players. The bingo card(s) 412 may be a 5×5 grid of cells formed by five rows and five columns. The five columns may be labeled with B, I, N, G, and O. Each of the cells may include a number. In some embodiments, instead of a number, the cell in the center row and center cell may include a symbol or mark indicating a free cell.

The bingo game display portion 410 may further include a number listing 414. The server 310, 320 hosting the bingo game having a plurality of players may randomly generate a sequence of number forming the number listing 414. The server 310, 320 may provide the number listing 414 to the gaming devices 200A-X involved in the bingo game for display at the gaming devices 200A-X. The server 310, 320 may compare the sequence of numbers in the number listing 414 to each of the bingo cards 412 to identify matching numbers. In an exemplary embodiment, the matching numbers may be visually distinguished from non-matching numbers in the bingo card(s) and/or the number listing by a different color, highlighting, or any suitable visual distinction.

The server 310, 320 may apply bingo game rules to determine one or more winning players. The bingo game rules may define various winning combinations of matching numbers, such as a full row of matching numbers, a full column of matching numbers, and five matching numbers aligned diagonally. The player or players of a plurality of players participating in the bingo game that achieve a winning combination may be awarded a payout based on an amount wagered and an associated predefined pay table. The bingo game outcome may be a loss for player(s) not achieving the winning combination and/or if another player achieves a winning combination first. The winning or losing bingo game outcomes for each bingo card 412 are provided to the corresponding gaming device 200A-X.

The winning or losing bingo game outcome may be simulated in the spinning reel game display portion 420. For example, in response to a wager on the bingo game, a player may be provided with a spin of the reels in the spinning reel game. The outcome of reel spin in the spinning reel game is equivalent to the winning or losing bingo game outcomes shown in the bingo game display portion 410. The spinning reel game display portion 420 includes reels 422 each having display positions 424 for presenting symbols 426. For example, the spinning reel game display portion 420 may provide three, five, or any suitable number of reels 422. The reels 422 may each have three or any suitable number of display positions 424. In the exemplary embodiments of FIGS. 4A-D and 5A-D, five reels 422 each having three display positions 424 are shown. The spinning reel game display portion 420 also includes one or more symbol collectors 430. The symbol collector(s) 430 may be presented with the spinning reels 422, such as directly above the spinning reels 422 as shown in FIGS. 4A-D and 5A-D or at any suitable location. The symbol collector(s) 430 may be game characters such as a honey pot or any suitable game character. The symbol collector game character(s) 430 may be configured to show various states of symbol collection, such as empty, partially-filled, or full. In various embodiments, a tally of the number of feature symbols 428 or a corresponding credit amount may be presented on or near each of the symbol collector game characters 430. In certain embodiments, a tally of the number of feature symbols collected or a corresponding credit amount is not presented at the display 400.

The symbols 426 may include standard symbols 426 and feature symbols. The feature symbols may be a pre-defined symbol or symbols that are collected by the symbol collector (s) 430. For example, the feature symbols may be honey bees and the symbol collector game character(s) 430 may be honey pots.

After a bingo game wager is placed and the bingo game outcome is provided to the gaming device 200, the game controller 302 of the gaming device 200 may determine an array of symbols to present to provide a prize equivalent to the winning or losing outcome of the bingo game. The game controller 302 is configured to cause the reels in the spinning reel game display portion 420 to spin and then stop to present the determined array of symbols 426 at display positions 424 of the reels 422.

The game controller 302 analyzes the displayed array of symbols 426 to determine whether the array of symbols 426 includes one or more feature symbols, such as honey bee feature symbols or any suitable feature symbols. The game controller 302 causes the spinning reel game display portion 420 to show the collection of each of the feature symbols or a portion of each of the feature symbols in the symbol collector(s) 430. In certain embodiments, the feature symbol 428 may be a sub-symbol presented at a display position 424 with a standard symbol 426. In such embodiments, the feature sub-symbol 428 may be collected and the standard symbol 426 may be left at the display position 424.

The game controller 302 is operable to cause the display 400 to update to show a representation of the feature symbols collected in the symbol collector(s) 430. For example, the game controller 302 may update the spinning reel game display portion 420 to show an increased amount of honey added to the honey pot symbol collector(s) 430 that received the honey bee feature symbols. In some embodiments, a tally of the number of feature symbols collected or a corresponding credit amount may be presented on or near each of the symbol collector game character(s) 430. The tally may be incremented with the addition of the feature symbols to the symbol collector(s) 430. In various embodiments, a tally of the number of feature symbols collected or a corresponding credit amount is not presented at the display 400.

Figure 4B:
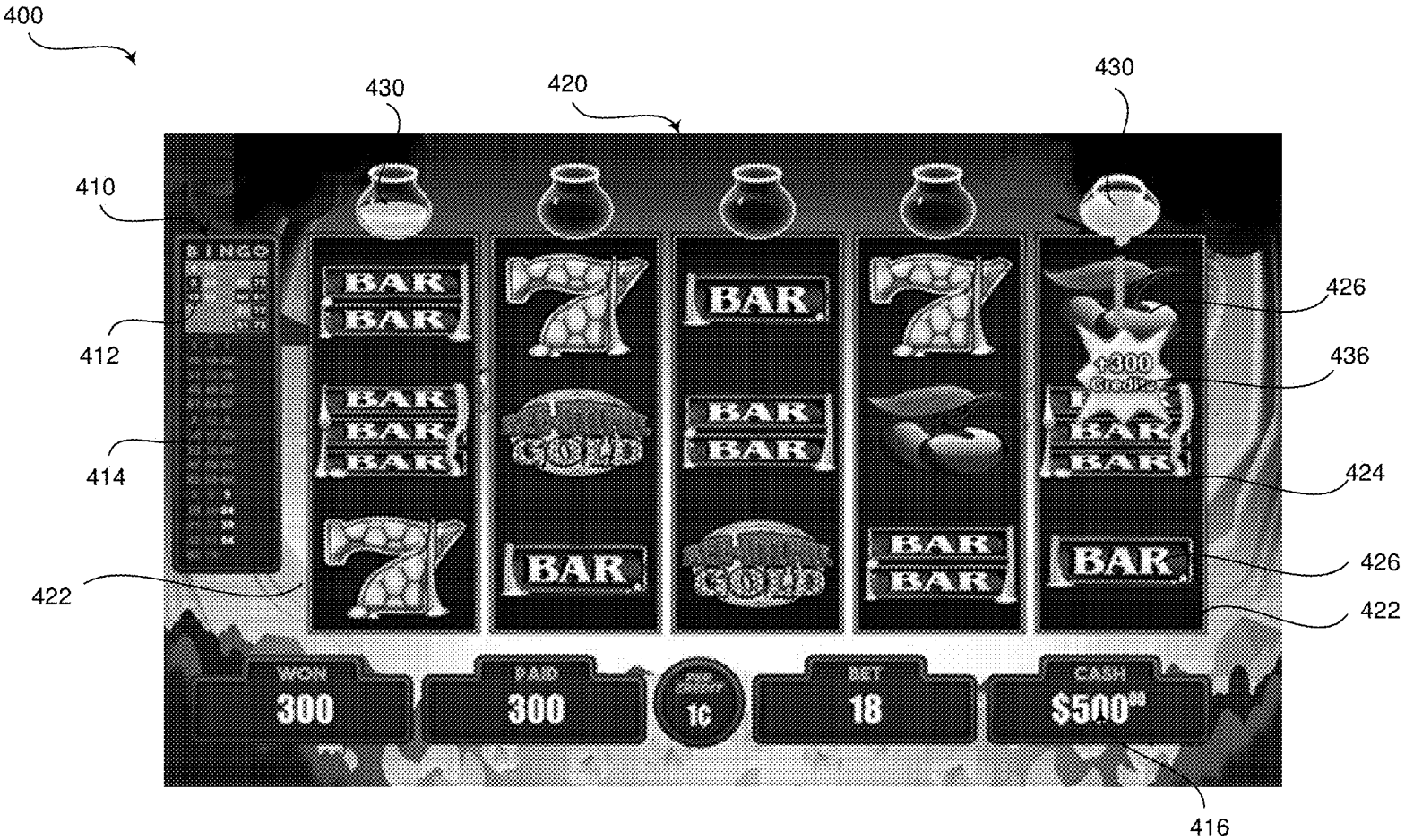
Figure 5A:
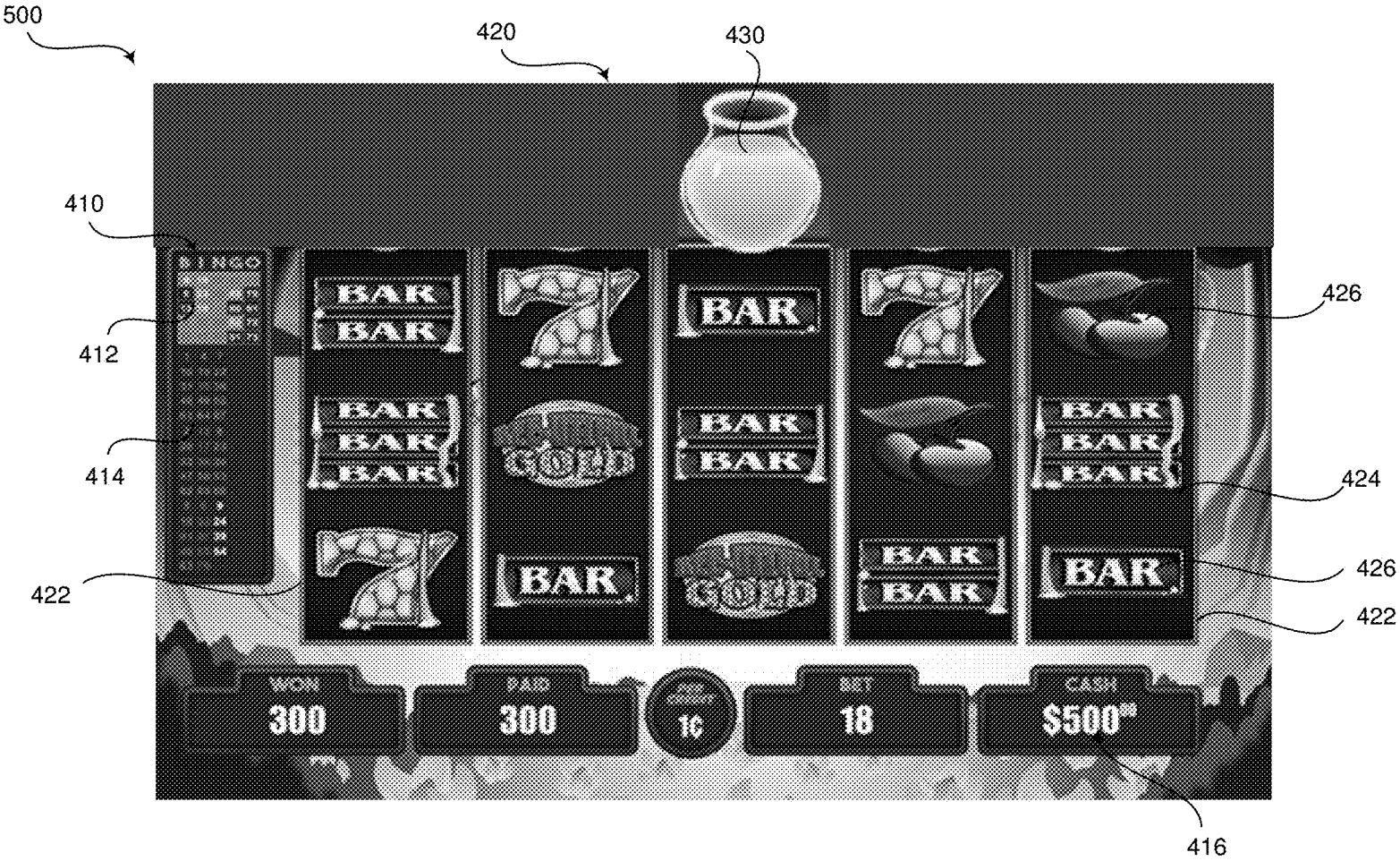
FIGS. 5A-D depict an exemplary embodiment of a display at the gaming device of FIG. 1 in various stages of exemplary processes for partially paying out credits from a symbol collector corresponding with feature symbols collected in the symbol collector while simulating a bingo game outcome via the spinning reel game in FIGS. 6A-C depict another exemplary embodiment of a display at the gaming device of FIG. 1 in various stages of exemplary processes for partially paying out specials symbols based on feature symbols collected in one or more symbol collectors by replacing at least one of the symbols presented at a display position in a spinning reel game with the special symbol while simulating a bingo game outcome via the spinning reel game in accordance with various aspects of the present disclosure.

Referring to FIGS. 4A and 5A, after the symbol collection process described above is complete, the game controller 302 of the gaming device 200 may determine whether a winning outcome has occurred based on the array of symbols 426 presented at the display positions 424 of the reels 422 and/or a fill level (e.g., full) of the symbol collector(s) 430. In various embodiments, the game controller 302 of the gaming device may cause the symbol collector(s) 430 to wobble, shake, flash, or the like to draw attention to a forthcoming payment of credits from the symbol collector(s) 430.

Figure 5B:
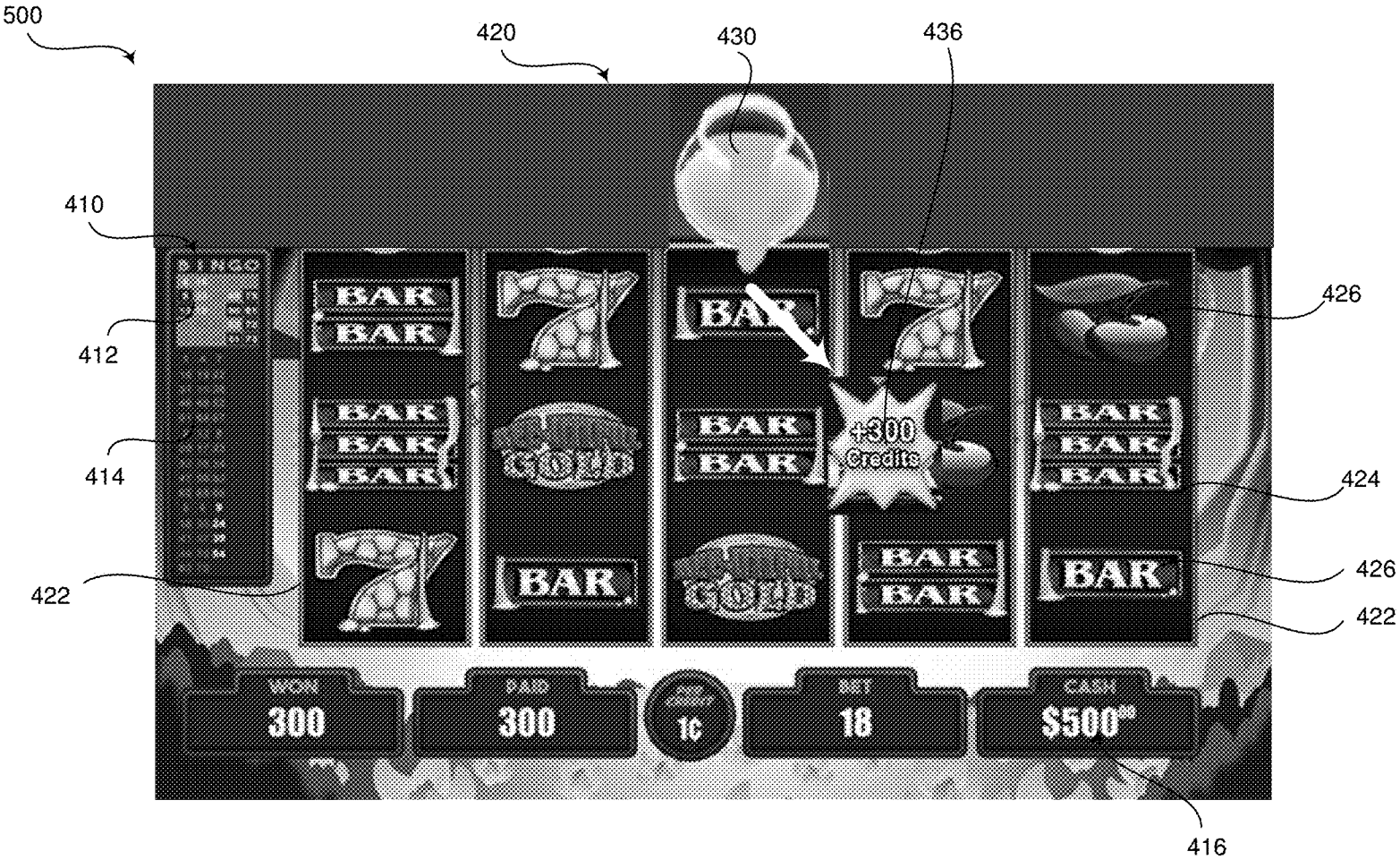

Referring to FIGS. 4B and 5B, the game controller 302 may be configured to cause credits corresponding to the bingo game outcome to be removed from the symbol collector(s) 430. In some embodiments, the awarded credit may correspond with a fill-state of the symbol collector 430 (e.g., full) and/or a winning combination displayed on the reels. As shown in FIGS. 4B and 5B, a honey pot symbol collector 430 may tip over to release the 300 credits corresponding to the bingo game outcome from the honey pot symbol collector 430. In an exemplary embodiment, only a portion of the symbol collector 430 is emptied to award the credit prize corresponding with the bingo game outcome. For example, the symbol collector 430 awarding the credit prize may have a fill-state (e.g., full) and/or a corresponding tally identifying an amount of feature symbols collected (e.g., 5 feature symbols) or a credit value (e.g., 500 credits). The game controller 302 may be operable to one or more of decrease the fill-state to partially-filled, decrease the number of feature symbols collected (e.g., from 5 to 2), and/or decrease the credit value (e.g., from 500 to 200 credits) in response to an award of a 300 credit prize.

Figure 5C:
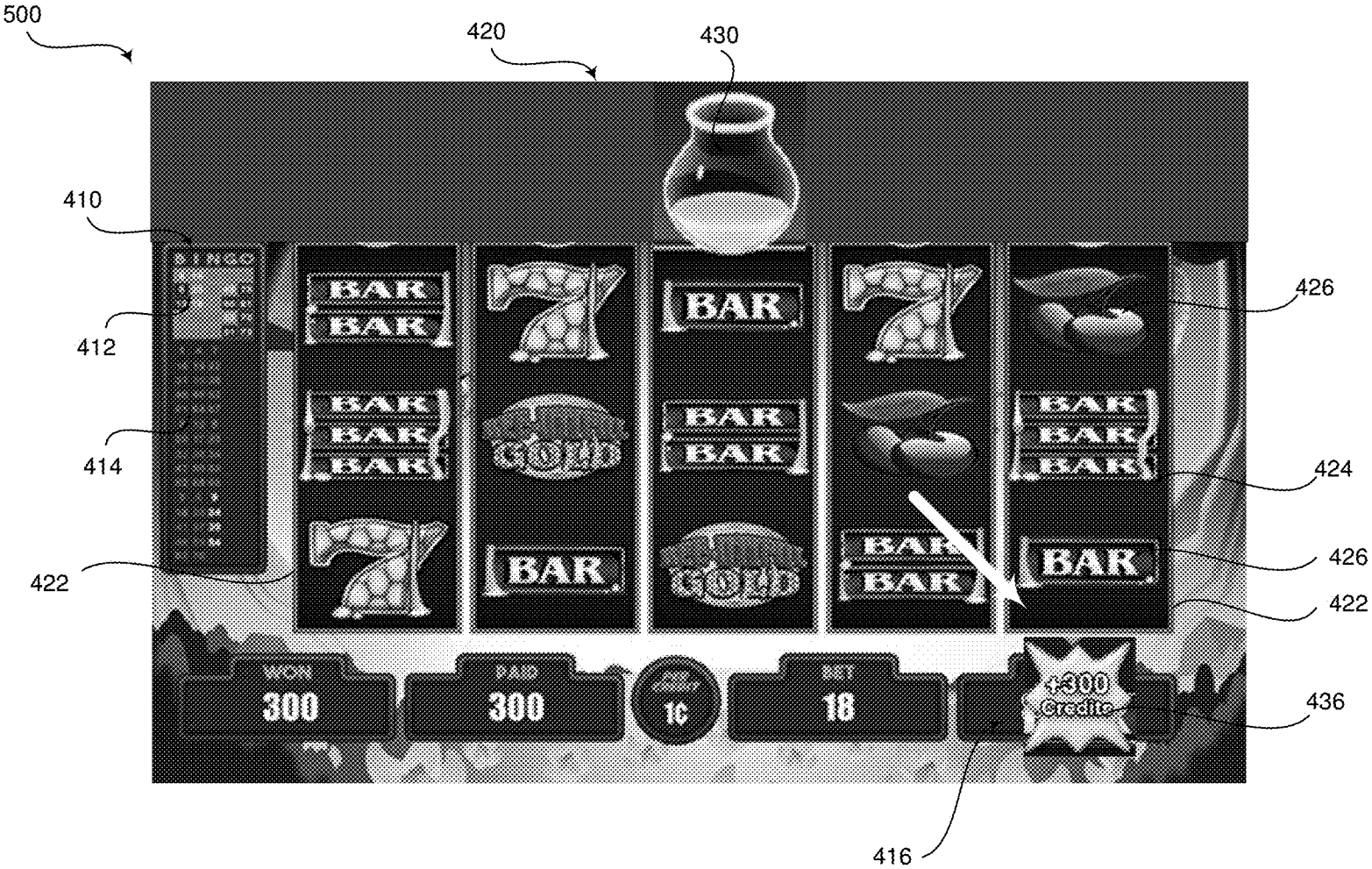

Referring to FIGS. 4C and 5C, the game controller 302 may be configured to visually present the awarded credit prize moving from the symbol collector 430 to the credit meter 416. For example, the game controller 302 may cause the awarded 300 credits to appear as though it is falling from the symbol collector 430 to the credit meter 416 as shown in FIGS. 4C and 5C.

Figure 4D:
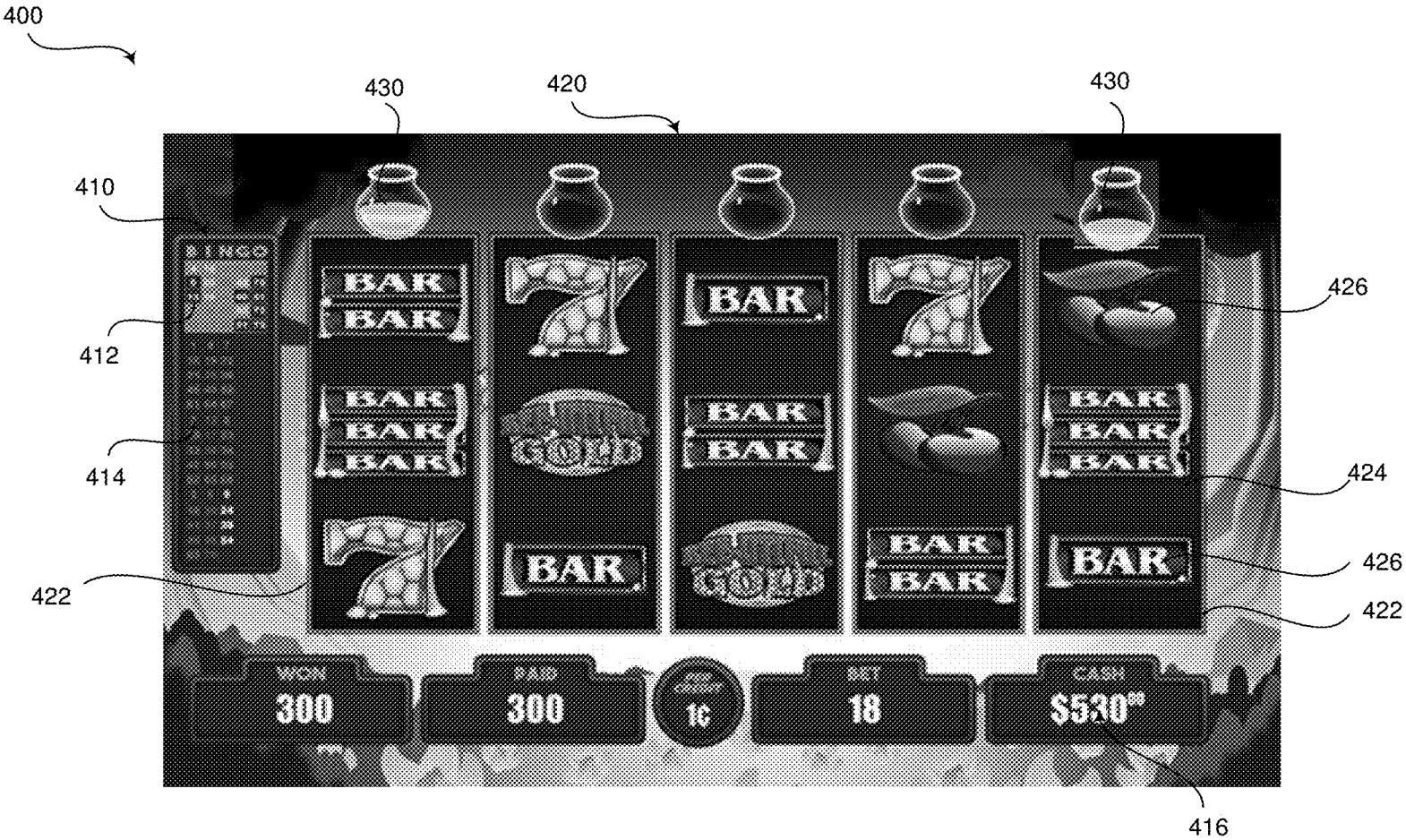
Figure 5D:
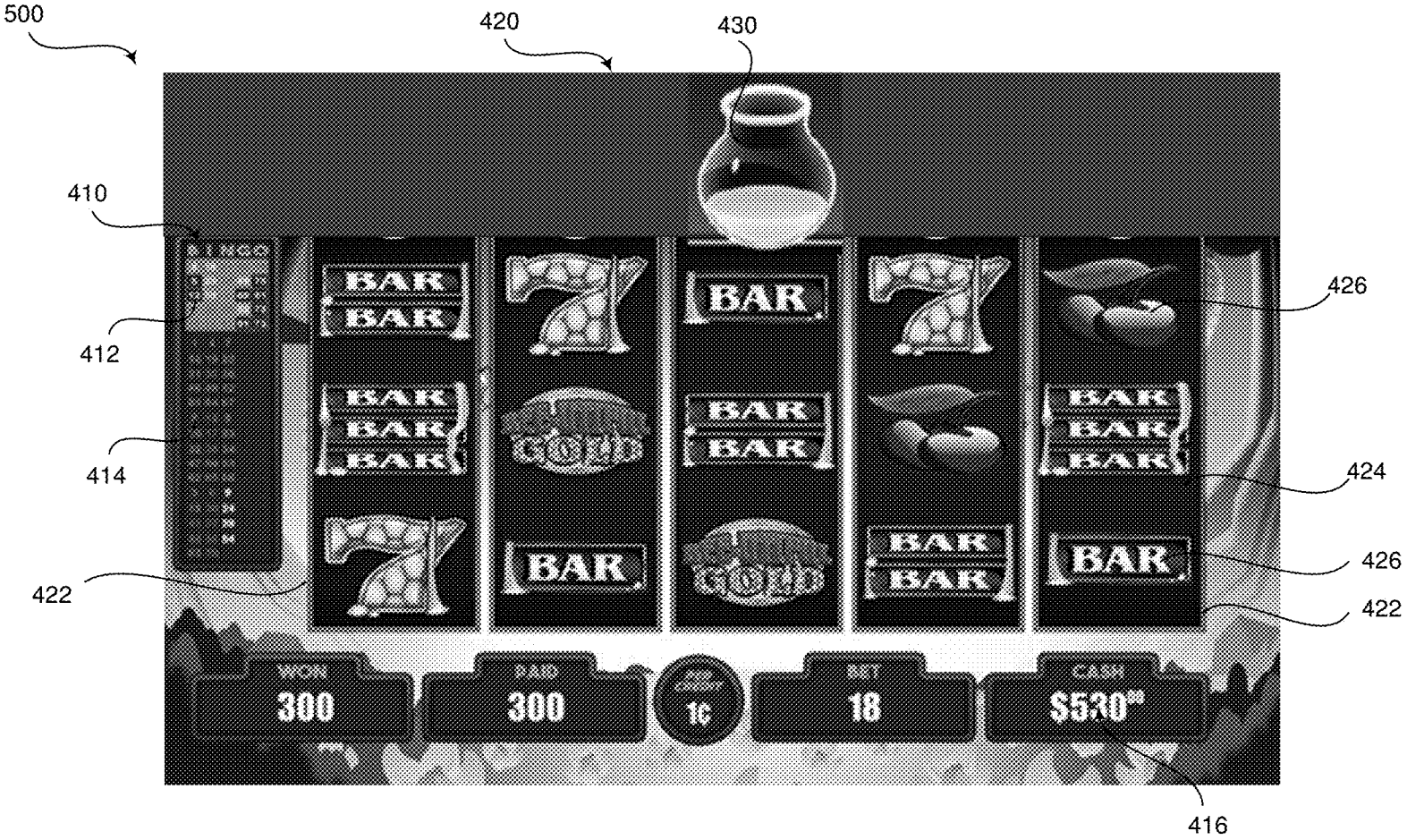

Referring to FIGS. 4D and 5D, the game controller 302 updates the credit meter 416 to reflect the awarded credit prize. For example, once the 300 credits arrives at the credit meter 416, the game controller 302 may update the credit meter 416 to show a balance of $530.00 instead of the $500.00 balance shown in FIGS. 4A-C and 5A-C.

Figure 6A:
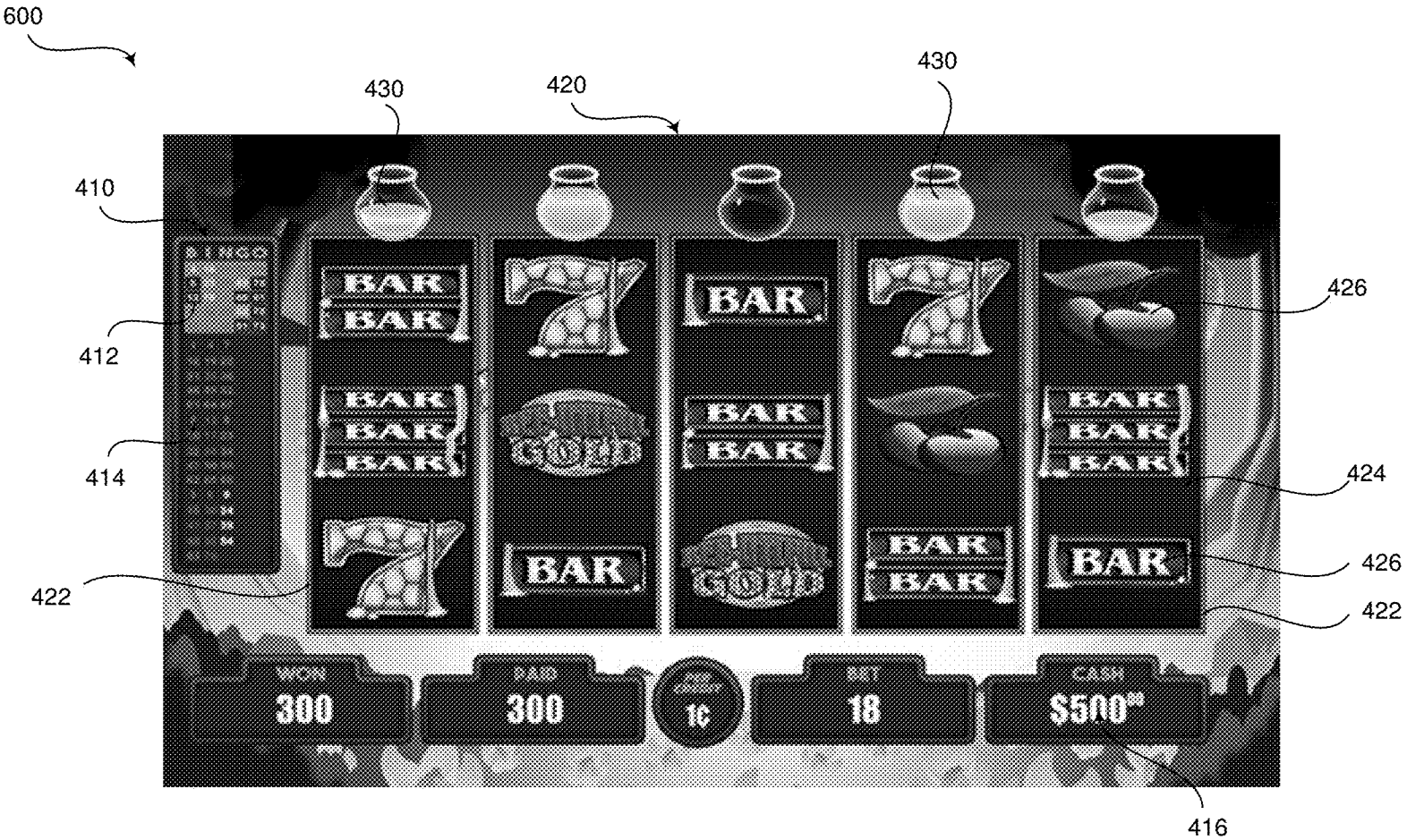
Figure 6B:
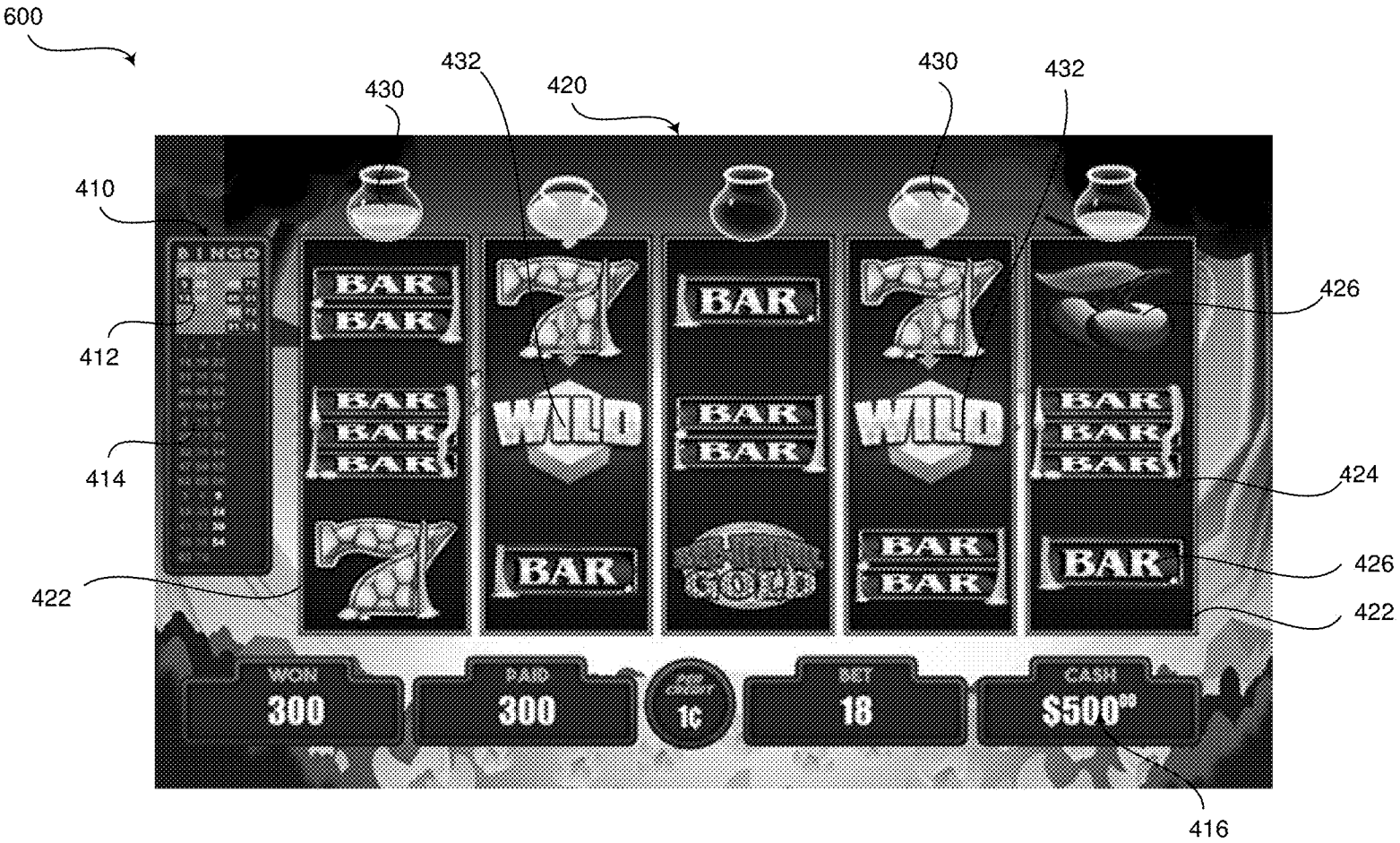
Figure 6C:
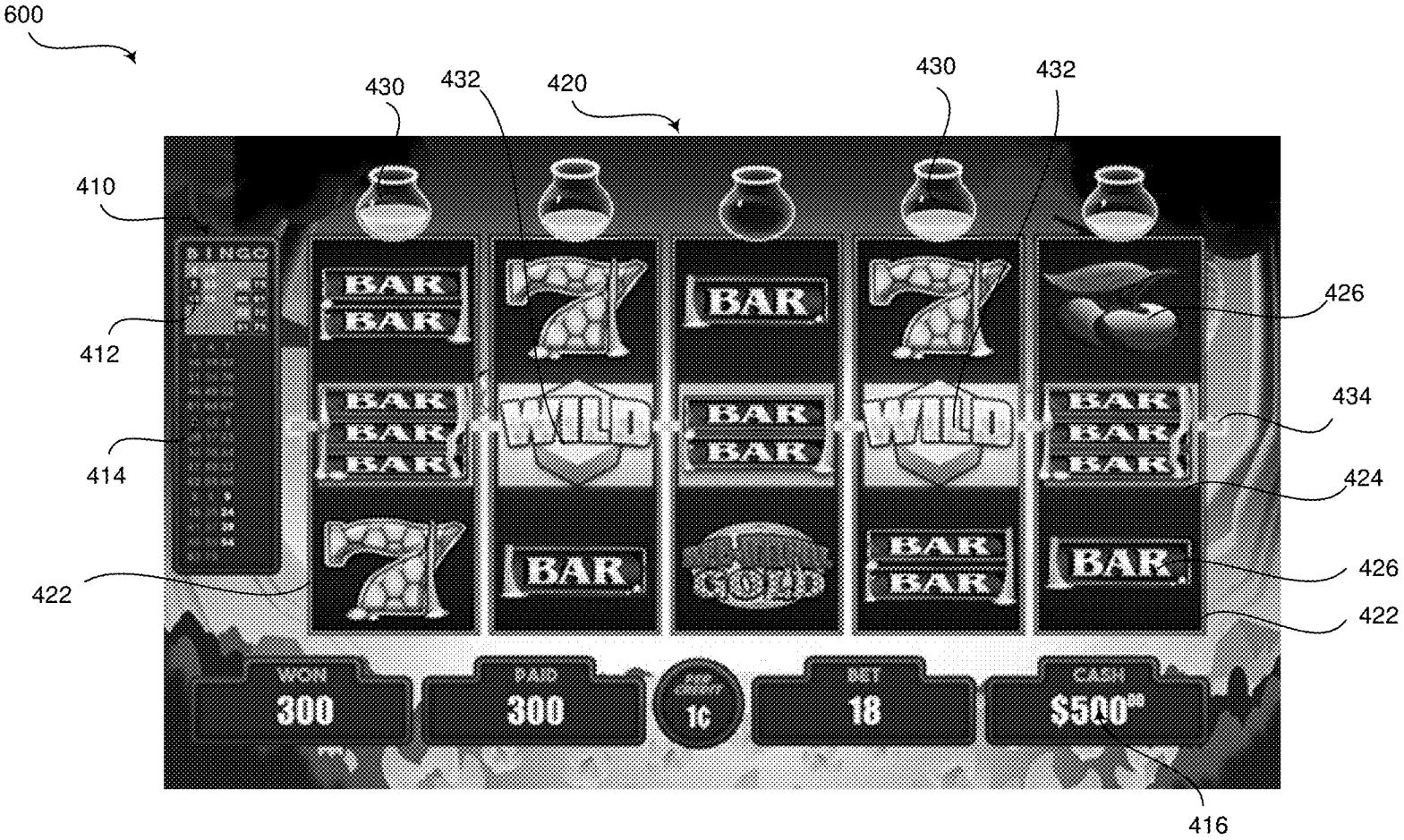

FIGS. 6A-C depict another exemplary embodiment of a display 600 at the gaming device 200 of FIG. 1 in various stages of exemplary processes for partially paying out specials symbols 432 based on feature symbols collected in one or more symbol collectors 430 by replacing at least one of the symbols 426 presented at a display position 424 in a spinning reel game with the special symbol 432 while simulating a bingo game outcome via the spinning reel game in accordance with various aspects of the present disclosure. Referring to FIGS. 6A-6C, the display 600 may be presented, for example, at a main display 214 of the gaming device 200. The display 500 may include a bingo game display portion 410, a spinning reel game display portion 420, and a credit meter 416 showing the amount of credits 416 held by a player of the gaming device 200 as described above with reference to FIGS. 4A-D and 5A-D. The bingo game display portion 410 may include one or more bingo cards 412 acquired by a player based on a wager and a number listing 414. The winning or losing bingo game outcome may be simulated in the spinning reel game display portion 420. The spinning reel game display portion 420 includes reels 422 each having display positions 424 for presenting symbols 426, 432. The spinning reel game display portion 420 also includes one or more symbol collectors 430. The symbols 426, 432 may include standard symbols 426 and special symbols 432. The special symbols 432 may be a pre-defined symbol or symbols that are distributed to display positions 424 of the reels 422 from symbol collector(s) 430. For example, in the exemplary embodiment illustrated in FIGS. 6A-C, the special symbols 432 may be WILD symbols distributed by the symbol collector(s) 430.

Referring to FIG. 6A, after the symbol collection process described above is complete, the game controller 302 of the gaming device 200 may determine whether a winning outcome has occurred based on a fill level (e.g., full and/or partially-filled) of the symbol collector(s) 430. In various embodiments, the game controller 302 of the gaming device may cause the symbol collector(s) 430 to wobble, shake, flash, or the like to draw attention to a forthcoming distribution of special symbols 432 from the symbol collector(s) 430.

Referring to FIG. 6B, the game controller 302 may be configured to cause special symbols 432 to be removed from one or more of the symbol collectors 430 and applied in place of standard symbols 426 at display positions 424 on reels 422. In various embodiments, the amount of special symbols 432 provided by the symbol collector(s) 430 may correspond with a fill-state of the symbol collector 430. For example, a partially-filled symbol collector 430 may create one special symbol 432 and a full symbol collector 430 may create a stack of special symbols 432 that may replace all of the display positions 424 of one reel 422. In some embodiments, only a portion of the symbol collector(s) 430 may be emptied to provide special symbols 426. As shown in FIG. 6B, honey pot symbol collectors 430 may tip over to release the special symbols 432 that fall from the honey pot symbol collectors 430 to display positions 424 on the reels 422.

Referring to FIG. 6C, after the one or more special symbols 432 replace corresponding standard symbols 426 in the array of symbols 426, the game controller 302 may evaluate the array of symbols 426, 432 to determine whether the array of symbols includes a winning combination of symbols 434. If any winning combination of symbols is present, the game controller 302 may award prizes for each winning combination of symbols 434. For example, the gaming device may increase a credit meter 416 by a number of credits specified in a pay table for the winning combination of symbols 434. In various embodiments, the winning combination of symbols 434 may be highlighted or otherwise identified in the array of symbols. In an exemplary embodiment, the awarded special symbols 432 may or may not contribute to a winning combination of symbols 434. The awarded prizes are equivalent to the prize awarded by the bingo game outcome.

Figure 7:
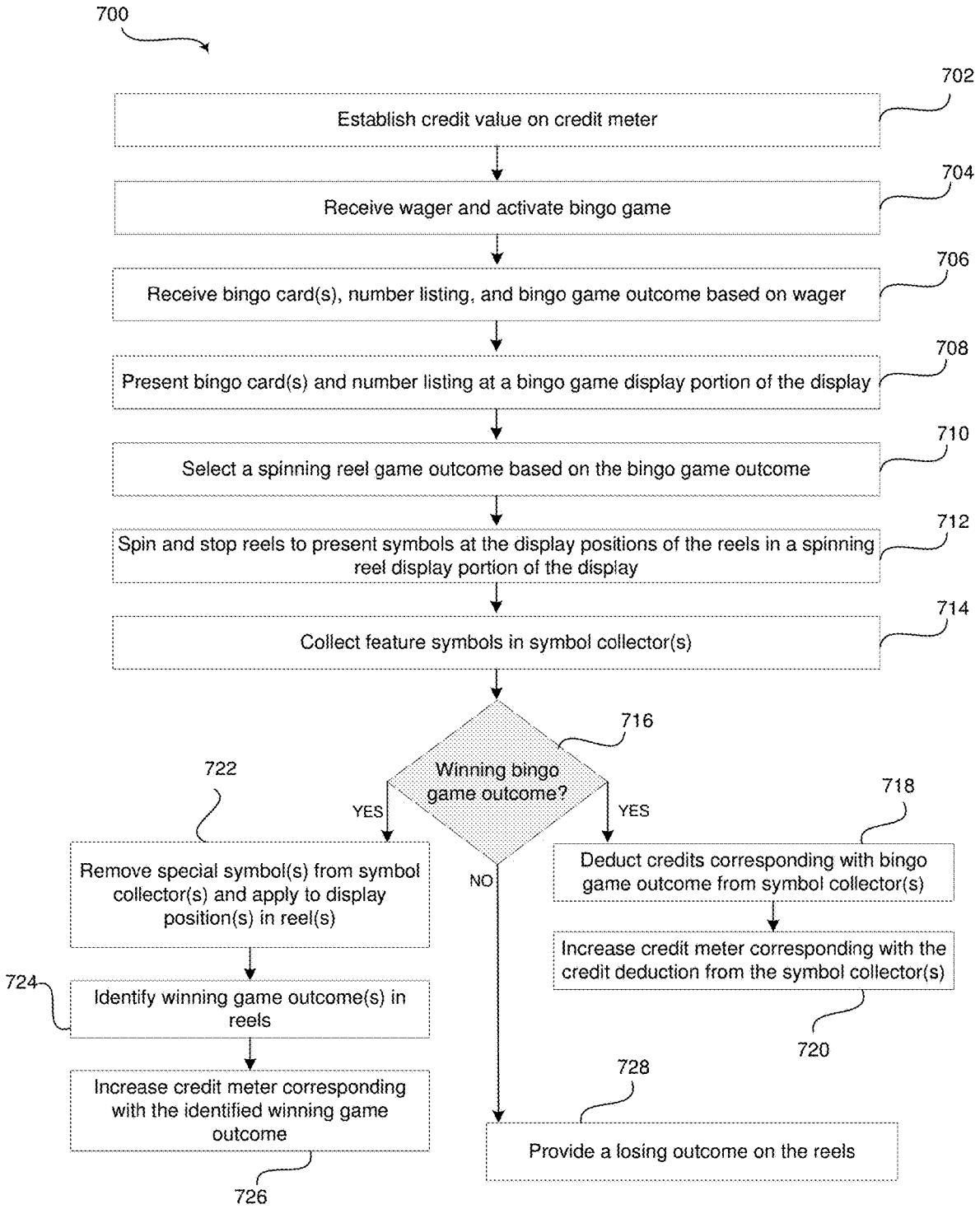
FIG. 7 provides a flowchart for an exemplary embodiment of a process for presenting, at the gaming device of FIG. 1, a simulation of a bingo game outcome via a spinning reel game having one or more symbol collectors in accordance with various aspects of the present disclosure.

FIG. 7 provides a flowchart 700 for an exemplary embodiment of a process 702-728 for presenting, at the gaming device 200 of FIG. 1, a simulation of a bingo game outcome via a spinning reel game having one or more symbol collectors 430 in accordance with various aspects of the present disclosure. While presented as a simulated game in method 700, the spinning reel game may also be implemented as a primary or base game, bonus game, or secondary game of the gaming device 200.

At step 702, the gaming device 200 may establish an associated credit value on a credit meter 416. To this end, a player may insert a physical item having monetary value into a credit input mechanism 210 of the gaming device 200. In response to the received physical item, the gaming device 200 may increase a credit value of the credit meter 416 based on the monetary value of the physical item.

At step 704, the gaming device 200 may receive a wager and may activate a bingo game. In particular, a player may actuate one or more buttons 208 of the gaming device 200 to specify a value of a wager funded by the credit value of the credit meter 416. Furthermore, in some embodiments, the gaming device 200 may communicate with a server 310, 320 over a network 312 based on the specified value of the wager to join a bingo game having a plurality of players. A game controller 302 of the gaming device 200 decreases the credit meter 416 by the specified wager and initiates play of the bingo game, the results of which are simulated by a spinning reel game at the gaming device 200.

After receiving the wager and activating the bingo game, the game controller 302 of the gaming device 200 at step 706 may receive one or more bingo card(s) 412, a number listing 414, and a bingo game outcome based on the wager. The bingo game outcome may be a credit value prize to be awarded via the simulated spinning reel game.

At step 708, the game controller 302 of the gaming device 200 presents the bingo card(s) 412 and number listing 414 at a bingo game display portion 410 of a display 214, 400, 500, 600 of the gaming device 200 as shown in FIGS. 4A-D, 5A-D, and 6A-C. The bingo card(s) 412 and/or number listing 414 may include number coloring, shading, highlighting, or the like to identify matching numbers in the bingo card(s) 412 and number listing 414.

At step 710, the game controller 302 of the gaming device 200 may select a spinning reel game outcome based on the bingo game outcome. The spinning reel game outcome is equivalent to the bingo game outcome. For example, if the bingo game outcome is an award of 300 credits, the spinning game outcome may provide an award of 300 credits as well.

At step 712, the game controller 302 of the gaming device 200 may initiate play of the spinning reel game. In particular, the gaming device 200 may initiate the spinning reel game by spinning reels 422 in response to input received from the player. For example, the game controller 302 of the gaming device 200 may initiate play in response to the player pressing a button 208, pulling a handle, etc. of the gaming device 200. The reels 422 presented in the spinning reel game display portion 420 of the main display 214 of the gaming device may spin and stop to reveal an array of symbols 426 at display positions 424 of the reels 422. The symbols 426 in the array may include standard symbols 426 and feature symbols.

At 714, the game controller 302 of the gaming device 200 may collect feature symbols in symbol collectors 430 presented in the spinning reel game display portion 420. The collection of the feature symbols in the symbol collectors 430 updates a tally (e.g., symbol tally, credit tally, etc.) and/or a fill state (e.g., full, partially-filled, empty, etc.) of the symbol collectors 430.

If the bingo game outcome is a winning outcome at step 716, the process proceeds to either a first award process embodiment at steps 718 through 720 or a second award process embodiment at steps 722 through 726.

At step 718 in the first award process embodiment, the game controller 302 of the gaming device 200 deducts credits corresponding with the bingo game outcome from the symbol collector(s) 430 provided in the spinning reel game display portion 420 of the display 600. See, e.g., FIGS. 4B and 5B. For example, after the symbol collection process at steps 712 and 714 is complete, the game controller 302 of the gaming device 200 may determine whether a winning outcome has occurred based on the array of symbols 426 presented at the display positions 424 of the reels 422 and/or a fill level (e.g., full) of the symbol collector(s) 430. Based on the winning outcome, the game controller 302 removes credits corresponding to the bingo game outcome from the symbol collector(s) 430. In certain embodiments, only a portion of the symbol collector 430 is emptied to award the credit prize corresponding with the bingo game outcome. In some embodiments, the symbol collector 430 may tip over to distribute the credit award that falls from the symbol collector 430 to the credit meter 416. See, e.g., FIGS. 4B and 5B. In various embodiments, the game controller 302 of the gaming device 200 may display the awarded credit prize moving from the symbol collector 430 to the credit meter 416. See e.g., FIGS. 4B-C and 5B-C.

At step 720, the game controller 302 increases the credit meter 416 to reflect the awarded credit prize corresponding with the credit deduction from the symbol collector(s) 430. See, e.g., FIGS. 4C-D and 5C-D. The credit increase to the credit meter 416 matches the bingo game outcome.

At step 722 in the second award process embodiment, the game controller 302 of the gaming device 200 may remove one or more special symbols 432 from the symbol collector (s) 430 and apply the special symbol(s) 432 to display position(s) 424 in reels 422 presented in the spinning reel game display portion 420. See, e.g., FIGS. 6A-B. For example, after the symbol collection process at steps 712 and 714 is complete, the game controller 302 of the gaming device 200 may determine whether a winning outcome has occurred based on a fill level (e.g., full and/or partially-filled) of the symbol collector(s) 430. The game controller 302 of the gaming device 200 removes the special symbols 432 from the symbol collector(s) 430 and applies each special symbol 432 to replace a standard symbol 426 at display positions 424 on reels 422. The special symbol(s) 432 may be WILD symbols or any suitable symbol having a higher value than standard symbols 426. The amount of special symbols 432 provided by the symbol collector(s) 430 may correspond with a fill-state of the symbol collector 430. In various embodiments, only a portion of the fill-state of the symbol collector(s) 430 may be emptied to provide special symbols 426. In certain embodiments, the symbol collector 430 may tip over to distribute the special symbol 432 that falls from the symbol collector 430 to a display position 424 on the reels 422. See, e.g., FIG. 6B.

At step 724, the game controller 302 may evaluate the array of symbols 426, 432 to determine whether the array of symbols includes a winning combination of symbols 434. In various embodiments, the winning combination of symbols 434 may be highlighted or otherwise identified in the array of symbols. See, e.g., FIG. 6C.

At step 726, if a winning combination of symbols 434 is identified at step 724, the game controller 302 may award prizes for each winning combination of symbols 434. For example, the gaming device may increase a credit meter 416 by a number of credits specified in a pay table for the winning combination of symbols 434. The winning combination(s) of symbols 434 may have a prize value equivalent to the prize awarded by the bingo game outcome. In an exemplary embodiment, the awarded special symbols 432 may or may not contribute to a winning combination of symbols 434.

If the bingo game outcome is a losing outcome at step 716, the process proceeds to step 728 where the game controller 302 of the gaming device 200 presents a losing outcome on reels 422. For example, the losing outcome may correspond to a reel spin in response to a user input (e.g., button depression, handle pull, etc.) that results in no winning combinations being displayed at the array of symbols 426 provided by reels 422 and/or the symbol collector(s) failing to reach a fill-state corresponding with a winning outcome.

In response to a winning or losing outcome, the game controller 302 of the gaming device 200 may terminate play of the current game and may determine whether the player wishes to terminate the current gaming session. For example, the player may press a button 208 of the gaming device 200 to "cash out" and terminate the gaming session. If the player terminates the gaming session, the game controller 302 of the gaming device 200 may cash out any remaining credit value on the credit meter to the player via a credit output mechanism of the gaming device. For example, the gaming device 200 may transfer the remaining credit value by dispensing the appropriate number of coins via a coin tray or by printing a ticket with the appropriate monetary value via a printer 230A. If the player wishes to continue the gaming session, the gaming device 200 may return to step 704 to permit the player to adjust the wager and activate a new bingo game.

The present disclosure describes only exemplary embodiments. Modifications of the above disclosed apparatus and methods which fall within the scope of the appended claims will be readily apparent to those of ordinary skill in the art. For example, although the examples discussed above are illustrated for a gaming market, embodiments of the disclosure can be implemented for other markets.

What is claimed is:

1. A gaming device, comprising:

a display device configured to present a spinning reel game display portion including one or more symbol collectors and a plurality of reels having display positions for presenting symbols comprising one or more of standard symbols, feature symbols, and special symbols; and a game controller configured to:

spin the plurality of reels to obtain a spinning reel game outcome, wherein the spin of the plurality of reels provides an array of the symbols;

animate a collection of the feature symbols by visually moving the feature symbols across at least a portion of the display device from the array of the symbols into the one or more symbol collectors, wherein each of the one or more symbol collectors provides a visual representation corresponding to a number of the feature symbols collected in a respective one of the one or more symbol collectors; and animate an award by visually moving the award across at least a portion of the display device from at least one of the one or more symbol collectors if the spinning reel game outcome corresponds with a winning game outcome independent of the collection of the feature symbols, wherein the award is a portion of the visual representation corresponding to the number of feature symbols collected in the at least one of the one or more symbol collectors, wherein the award provided from the at least one of the one or more symbol collectors is a credit amount that visually moves across at least a portion of the display device from the at least one of the one or more symbol collectors to a credit meter on the display device.

2. The gaming device of claim 1, wherein:

the display device is configured to present a bingo game display portion including one or more bingo cards and a number listing, and the game controller is configured to:

receive the one or more bingo cards, the number listing, and a bingo game outcome in response to a wager;

select the spinning reel game outcome based on the received bingo game outcome; and increase a credit balance by an amount equivalent to the bingo game outcome at least in part in response to the award provided from the at least one of the one or more symbol collectors.

3. The gaming device of claim 1, wherein one or both of:

the visual representation is reduced by an amount corresponding to the award provided from the at least one of the one or more symbol collectors, and the visual representation is one or more of:

a credit tally;

a feature symbol tally; and a fill-level of the respective one of the one or more symbol collectors.

4. A method of playing a wagering game via a gaming device having a game controller and a display device, the method comprising:

presenting, in the display device, a spinning reel game display portion configured to present one or more symbol collectors and a plurality of reels having display positions for presenting symbols comprising one or more of standard symbols, feature symbols, and special symbols;

spinning, via the game controller, the plurality of reels to obtain a spinning reel game outcome, wherein the spin of the plurality of reels provides an array of the symbols;

animating, via the game controller, a collection of the feature symbols by visually moving the feature symbols across at least a portion of the display device from the array of the symbols into the one or more symbol collectors, wherein each of the one or more symbol collectors provides a visual representation corresponding to a number of the feature symbols collected in a respective one of the one or more symbol collectors;

animating, via the game controller, an award by visually moving the award across at least a portion of the display device from at least one of the one or more symbol collectors if the spinning reel game outcome corresponds with a winning game outcome independent of the collection of the feature symbols, wherein the award is a portion of the visual representation corresponding to the number of feature symbols collected in the at least one of the one or more symbol collectors, wherein the animating the award comprises visually moving the award across at least a portion of the display device from the at least one of the one or more symbol collectors to a credit meter on the display device, wherein the award is a credit amount.

5. The method of claim 4, comprising:

presenting, in the display device, a bingo game display portion configured to present one or more bingo cards and a number listing;

receiving, via the game controller, the one or more bingo cards, the number listing, and a bingo game outcome in response to a wager;

selecting, via the game controller, the spinning reel game outcome based on the received bingo game outcome; and increasing, via the game controller, a credit balance by an amount equivalent to the bingo game outcome at least in part in response to the award provided from the at least one of the one or more symbol collectors.

6. The method of claim 4, comprising reducing on the display device the visual representation by an amount corresponding to the award provided from the at least one of the one or more symbol collectors, wherein the visual representation is one or more of:

a credit tally;

a feature symbol tally; and a fill-level of the respective one of the one or more symbol collectors.

7. A gaming system, comprising:

a gaming server; and a gaming device operatively coupled to the gaming server via a network, the gaming device comprising:

a display device configured to present a spinning reel game display portion including one or more symbol collectors and a plurality of reels having display positions for presenting symbols comprising one or more of standard symbols, feature symbols, and special symbols; and a game controller configured to:

spin the plurality of reels to obtain a spinning reel game outcome, wherein the spin of the plurality of reels provides an array of the symbols;

animate a collection of the feature symbols by visually moving the feature symbols across at least a portion of the display device from the array of the symbols into the one or more symbol collectors, wherein each of the one or more symbol collectors provides a visual representation corresponding to a number of the feature symbols collected in a respective one of the one or more symbol collectors; and animate an award by visually moving the award across at least a portion of the display device from at least one of the one or more symbol collectors if the spinning reel game outcome corresponds with a winning game outcome independent of the collection of the feature symbols, wherein the award is a portion of the visual representation corresponding to the number of feature symbols collected in the at least one of the one or more symbol collectors, wherein the award provided from the at least one of the one or more symbol collectors is a credit amount that visually moves across at least a portion of the display device from the at least one of the one or more symbol collectors to a credit meter on the display device.

8. The gaming system of claim 7, wherein:

the display device is configured to present a bingo game display portion including one or more bingo cards and a number listing, and the game controller is configured to:

receive the one or more bingo cards, the number listing, and a bingo game outcome in response to a wager;

select the spinning reel game outcome based on the received bingo game outcome; and increase a credit balance by an amount equivalent to the bingo game outcome at least in part in response to the award provided from the at least one of the one or more symbol collectors.

9. The gaming system of claim 7, wherein the visual representation is reduced by an amount corresponding to the award provided from the at least one of the one or more symbol collectors, and wherein the visual representation is one or more of:

a credit tally;

a feature symbol tally; and a fill-level of the respective one of the one or more symbol collectors.

* * * * *